US009913028B2

(12) United States Patent
Huber et al.

(10) Patent No.: US 9,913,028 B2
(45) Date of Patent: Mar. 6, 2018

(54) MIXING CONSOLE, MICROPHONE, AND MICROPHONE ADAPTER

(71) Applicant: Studer Professional Audio GmbH, Regensdorf (CH)

(72) Inventors: Robert Huber, Schlieren (CH); Roger Heiniger, Oberduernten (CH); Roman Riedi, Waedenswil (CH)

(73) Assignee: Studer Professional Audio GmbH, Regensdorf (CH)

( * ) Notice: Subject to any disclaimer, the term of this patent is extended or adjusted under 35 U.S.C. 154(b) by 99 days.

(21) Appl. No.: 14/549,174

(22) Filed: Nov. 20, 2014

(65) Prior Publication Data

US 2015/0146891 A1 May 28, 2015

(30) Foreign Application Priority Data

Nov. 22, 2013 (EP) ..... 13194019

(51) Int. Cl.

| | |
|---|---|
| ***H04R 3/00*** | (2006.01) |
| ***H04H 60/04*** | (2008.01) |
| ***H04R 1/08*** | (2006.01) |
| *H04R 29/00* | (2006.01) |

(52) U.S. Cl.

CPC ..... *H04R 3/005* (2013.01); *H04H 60/04* (2013.01); *H04R 1/083* (2013.01); *H04R 29/008* (2013.01); *H04R 2420/07* (2013.01); *H04R 2499/11* (2013.01)

(58) Field of Classification Search

None

See application file for complete search history.

(56) References Cited

U.S. PATENT DOCUMENTS

| | | | | |
|---|---|---|---|---|
| 2005/0220314 | A1* | 10/2005 | Lang | H04R 3/00 381/113 |
| 2007/0113727 | A1 | 5/2007 | Ganley et al. | |
| 2008/0175413 | A1* | 7/2008 | Okabayashi | H04L 67/125 381/119 |
| 2012/0299937 | A1 | 11/2012 | Brown et al. | |

OTHER PUBLICATIONS

Extended European Search Report for corresponding Application No. 13 194 019.9, dated Apr. 2, 2014, 7 pages.

* cited by examiner

*Primary Examiner* — Paul Huber

(74) *Attorney, Agent, or Firm* — Brooks Kushman P.C.

(57) ABSTRACT

A mixing console including a plurality of audio inputs and a plurality of audio processing channels. Control data is received from a microphone which is connected to a given audio input to provide audio data. The control data includes an indication of an audio source associated with a microphone. A router of the mixing console is configured to route the audio data from the given audio input to a given audio processing channel based on the received indication of the audio source.

16 Claims, 6 Drawing Sheets

500

| | LABEL | INPUT | CHANNEL | SNAPSHOT |
|---|---|---|---|---|
| 500-1a | Peter | 1 | 3 | Peter |
| 500-1b | Robert | 3 | 5 | Default |
| 500-1c | Sharon | 7 | n/a | Sharon |
| 500-1d | Ralf | 2 | 9 | Default |
| 500-1e | Hans | n/a | 3,7 | Sharon |

FIG. 5

MIXING CONSOLE, MICROPHONE, AND MICROPHONE ADAPTER

CROSS-REFERENCE TO RELATED APPLICATIONS

This application claims priority to EP Application No. 13 194 019.9, filed Nov. 22, 2013, the disclosure of which is incorporated in its entirety by reference herein.

TECHNICAL FIELD

Various embodiments relate to a mixing console, a microphone, and a microphone adapter. In particular, various embodiments relate to techniques of routing audio data in the mixing console based on control data received from the microphone.

BACKGROUND

Mixing consoles typically comprise a plurality of audio inputs and a plurality of audio processing channels. Sometimes these mixing consoles are also referred to as audio mixing consoles. Often, user operation elements associated with the various audio processing channels are arranged in columns. Each column typically corresponds to an audio processing channel. By actuating a user operation element of a column, a user of the mixing console can set audio processing properties for the particular audio processing channel.

Different audio equipment, for example, different microphones, is often processed using different audio processing properties. When considering microphones, in dependence on the audio source, for example, the speaker or particular instrument using the microphone, etc., the appropriate audio processing properties may vary. In this regard, the mixing console typically comprises a router which flexibly forwards audio data received at a given audio input to a given audio processing channel. The different audio channels are associated with the different audio processing properties, for example, tailored to the particular microphone connected with the respective audio input.

Therefore, as an effect, the audio processing properties of audio data received from a given microphone will depend on the audio input to which the given microphone is connected and the router setting. Reconnecting of the microphone should therefore occur at the same audio input, or cumbersome and error-prone reconfiguration of the router and/or of the audio processing properties of the respective audio processing channel may become necessary.

In this light, some mixing consoles provide aid in reconnecting audio equipment, for example, it may be possible to print out a setup chart which provides instructions to the user and/or technician indicating which microphone should be connected to which audio input. Further, some mixing consoles display a label on a multi-pixel display arranged in the column of a given audio processing channel. This label may be user-defined and describe the audio equipment so that the user can perceive which audio processing channel corresponds to which audio equipment.

However, such techniques face certain restrictions and drawbacks. For example, when reconnecting a microphone, there is a significant likelihood that the user erroneously plugs in the microphone to another audio input, thereby causing routing of the audio data to a different audio processing channel than intended, and, in turn, processing of the audio data using different audio processing properties than intended. In particular, this may be the case because the audio inputs may be located remote from the user interface of a particular audio processing channel. Moreover, the router configuration is typically not static. Further, often a large number of audio processing channels and/or audio inputs is available.

Therefore, a need exists for advanced techniques of audio mixing, in particular of routing audio data in a mixing console. A need exists for such techniques which reduce the likelihood of errors when reconnecting a given microphone to the mixing console where previously audio processing properties have been associated with a given audio processing channel. Further, a need exists for such techniques which enable to simplify the setup of the audio equipment and the mixing console.

SUMMARY

This need is met by the features of the independent claims. The dependent claims define embodiments.

According to an aspect, a mixing console having a plurality of audio inputs and a plurality of audio processing channels is provided. The mixing console comprises an interface configured to receive control data from a microphone. The microphone is connected to a given audio input to provide audio data. The control data includes an indication of an audio source associated with a microphone. The mixing console further comprises a router configured to route the audio data from the given audio input to a given audio processing channel based on the received indication of the audio source.

For example, the interface and the given audio input can be co-located. It is also possible that the interface is coupled to the audio input or is a separate entity. The audio data may be in analogue form or may be digitally encoded. For example, the audio data can be compressed digital data. It is possible that the audio data is according to the pulse-code-modulation (PCM) format, Audio Engineering Society (AES)/European Broadcasting Union (EBU) format, or the like. The control data may be in digital format, for example, in a packet-based predefined format. The control data may indicate the audio source explicitly or implicitly. For example, the control data can comprise an indication of the audio source according to predefined rules or policies. In a simple scenario, the indication of the audio source is an alphanumeric code. The indication of the audio source may have been set at some earlier point in time. For example, the audio source can specify a speaker associated with the microphone. It would alternatively or additionally be possible that the audio source specifies a location of the microphone in a broadcasting environment or certain musical instruments, etc. associated with the microphone. In general, the indication of the audio source may be a user-defined label which includes at least one alphanumeric character. In a simple scenario, the indication of the audio source may correspond to the name of a speaker associated with the microphone.

Such scenarios as mentioned above may be referred to as auto-routing: in dependence of the control data, the router of the mixing console is automatically configured to route the audio data received from the microphone to the intended audio processing channel. The user is fully or partly relieved from the need to plug in the microphone at one particular audio input.

In general, the router may be configured to route audio data from the given audio input to one or more audio processing channels. The router may be dynamically configured, i.e., a routing path for the given audio input may be reconfigured when needed. In general, the number of audio inputs may equal or may be different from the number of audio processing channels. For example, there may be 32, 128, or even 1000-2000 audio inputs and/or audio processing channels.

Such numbers of audio inputs and/or audio processing channels typically raise the complexity of operation and user handling of the mixing console. In particular, the user typically needs to keep track of the routing to ensure that the setting of certain audio processing properties affect the intended audio data received at a given audio input. In this light, techniques as mentioned above have the advantageous effect that the routing can be automated to a larger or smaller degree based on the received indication of the audio source. By receiving the indication of the audio source from the microphone by means of the control data, the router can be controlled such that the received audio data is automatically or semi-automatically forwarded to the intended audio processing channel. For example, a certain indication of an audio source can be assigned once to the given microphone; later on, the given microphone can be disconnected and reconnected at any audio input and the routing will be executed based on the received indication of the audio source such that the audio data is forwarded to one and the same given audio processing channel. In other words, the router can be configured to route the audio data independently or largely independently of the given audio input to which the microphone being associated with the indication of the audio source is connected. This increases the flexibility in connecting the microphone to the mixing console; in particular, it may be expandable that the microphone is plugged into one and the same audio input at every reconnection. A cable tangle may be avoided. Furthermore, handling of the mixing console becomes less error-prone. Unintentional errors when connecting the microphone to the mixing console can be avoided; this is because the routing can be executed based on the received indication of the audio source, which is independent of the particular audio input to which the microphone is connected.

For example, the mixing console may comprise a memory which is configured to store a predefined routing table which links the indication of the audio source with the given audio processing channel. The router may be configured to route the audio data to the given audio processing channel in dependence of a corresponding entry of the predefined routing table. In other words, the predefined routing table may be created and set up at one point in time; later on, when the microphone is disconnected and subsequently reconnected, the corresponding entry of the routing table may be accessed and the router can be configured to route based on this entry. The indication of the audio source allows accessing the corresponding entry of the routing table.

In general, the routing table can link the indication of the audio source with further parameters. For example, the routing table may further link the indication of the audio source with the given audio input and/or with at least one audio processing parameter. In addition, for example, the given audio input may be identified by predefined rules, such as by way of example, an appropriate index number. The stored parameters may be likewise provided and stored in a machine-readable, previously specified and/or negotiated format. It is alternatively or additionally possible to store configuration properties of the mixing console; thereby, it may be possible to configure the handling of operating elements of a particular audio processing channel, for example, lighting, default values, sensitivity, locked audio processing properties, etc., in dependence of the received indication of the audio source. All this enables to automatically retrieve user-specific and customized settings upon reconnection of a microphone.

By further providing a link between the indication of the audio source with the given audio input, it becomes possible to keep track of any variations in the audio input to which the microphone having the indication of the audio source is connected. For example, if the user reconnects the microphone to a different audio input, an information message could be issued and/or further appropriate measures, such as for example, in the control of the router and/or the audio processing, may be triggered. This increases the flexibility in operation of the mixing console and enables automatic or semi-automatic control of the mixing console.

The mixing console may further comprise a control entity configured to detect a connection setup of a further microphone at one of the plurality of audio inputs. The control entity may be configured to, in response to the detecting of a connection setup of the further microphone, create a new entry of the routing table in dependence of a user input and/or a predefined link between the respective audio input and one of the predefined channels.

By such techniques, it may be possible to flexibly increase the number of entries of the routing table. For example, if a further microphone is to be connected to the mixing console, it may be plugged into one of the audio inputs and the routing table can be configured accordingly from this point on, it becomes possible to flexibly plug in the further microphone into various audio inputs and, given the indication of the audio source becomes available via the control data from the further microphone, the routing can occur is such a manner that the audio data is forwarded to one and the same audio processing channel. When setting up the connection of the further microphone, it is possible that the user specifies the particular one or more audio processing channels to which the router should route the corresponding audio data.

The routing table may include a plurality of entries. The interface may be further configured to, in response to a request received from the microphone, signal to the microphone via the interface control data, which includes the indication of the audio source of one of the plurality of entries of the routing table.

By such techniques, the microphone may be made aware of the indication of the audio source provided by the routing table. Therefore, in general, the interface may allow for bi-directional data communication. This may enable to implement verification and feedback functionality. For example, it may be possible that the microphone comprises a multi-pixel display which displays the indication of the audio source received from the mixing console. By such techniques, it may be possible to avoid mixing up a plurality of microphones.

The interface may be further configured to, in a setup mode which assigns the audio source to the microphone, signal to the microphone further control data which includes the indication of the audio source, to thereby set the indication of the audio source at the microphone.

Therefore, in the setup mode, the indication of the audio source may be provided to the microphone to be stored in an internal memory of the microphone. Upon reconnection of the microphone to the mixing console, this indication of the audio source may be used for purposes of routing to the respective audio processing channel as discussed above.

The setup mode which assigns the audio source to the microphone may be triggered by one or more events selected from the group comprising: receiving control data from the microphone which includes a request for an indication of an audio source; actuating a user operation element of the mixing console associated with one of the plurality of audio signal channels; and receiving control data from the microphone which indicates actuation of a user operation element of the microphone. For example, the microphone can proactively request a certain indication of an audio source to be assigned. Then, the corresponding control data can be sent to the microphone as a respective response. Likewise, the assigning of the indication of the audio source may be triggered by actuating a corresponding user operation element.

It is possible that the mixing console further comprises, for each one of the plurality of audio processing channels: a multi-pixel display, which is configured to depict a label associated with the respective audio processing channel. The mixing console may further comprise a control entity which is configured to set the label associated with a given audio processing channel based on the received indication of the audio source. For example, the indication of the audio source can equal the label. However, it is possible that the indication of the audio source only comprises the label in some indirect or compressed manner. For example, the routing table can comprise a link between the indication of the audio source and the label associated with the respective audio processing channel. For example, the mixing console may further comprise, for each one of the plurality of audio processing channels: at least one user operation element, which is configured to enable control of at least one audio processing property of the respective audio processing channel. For example, the display may be arranged in the proximity of the at least one user operation element. For example, the display and the at least one user operation element belonging to a given audio processing channel may be aligned in a column.

By the techniques as mentioned above, it becomes possible to provide a fast overview to the user of the various links between audio processing channels and audio equipment, such as for example, microphones. The user may readily know which audio data is modified if a certain user operation element is actuated.

In general, any communication link which is suited for transmitting the control data may be employed. For example, the control data may be transmitted via a radio interface (e.g., employing the wireless local area network (WLAN) standard). Of course, it is also possible to provide a dedicated fixed-wire connection between the mixing console and the microphone for transmitting the control data. It is also possible that the interface is in connection with a given audio input and is configured to apply a phantom power to a wired audio connection for signaling of the audio data between the given audio input and the microphone. The interface may be configured to establish a data connection for signaling further control data to the microphone via modulation of the phantom power. The concept of phantom power is known in the context of powering of active electrical equipment, such as, for example, condenser microphones. Via modulation of the phantom power it may be possible to re-use the already existing connection for further transmission of the control data besides for the transmission of the audio data. This may enable a comparably simple setup where only few additional parts and cables may be required. Cable tangle may be avoided. Further, the transmission reliability may be comparably high.

As will be appreciated from the above, by employing the control data which includes the indication of the audio source, control of the router may be automated to a certain degree. This may also be referred to as auto-routing of the incoming audio data. For this, it may become necessary to provide certain logic functionality in the microphone as well. For example, the microphone may be equipped with a corresponding memory which stores the indication of the audio source between subsequent reconnections.

According to a further aspect, a microphone is provided which is in communication with the mixing console according to a further aspect of the present invention as discussed above. The microphone comprises a multi-pixel display, which is configured to depict a label based on the indication of the audio sources associated with the microphone.

The indication of the audio source may correspond to the label or may include the label in an indirect and/or encoded manner. By providing the multi-pixel display, which depicts the label, it may be ensured that, given there is a plurality of microphones, the association between a given microphone and a given audio source is not mixed up. In other words, if various microphones are associated with various speakers, it may be ensured that each speaker picks the correct microphone, as indicated by the label.

According to a further aspect, a method of controlling a mixing console having a plurality of audio inputs and a plurality of audio processing channels is provided. The method comprises receiving control data from a microphone, the microphone being connected to a given audio input to provide audio data. The control data includes an indication of an audio source associated with the microphone. The method further comprises routing the audio data from the given audio input to a given audio processing channel based on the received indication of the audio source.

For the method of controlling the mixing console according to the present aspect, effects may be achieved, which are comparable to the effects which may be achieved for the mixing console according to a further aspect of the present invention.

According to a further aspect, a microphone adapter attachable to an analogue microphone and configured to forward audio data received from the microphone to a mixing console is provided. The microphone adapter comprises an interface configured to receive control data from the mixing console. Further, the microphone adapter comprises a visual indication configured to operate based on the received control data.

For example, the analogue microphone together with the microphone adapter may be referred to as a microphone. The microphone adapter and/or the analogue microphone may comprise locking means to releasably engage with each other. The microphone adapter may comprise a suitable electric circuitry, such as, for example, one that is implemented based on a field programmable array (FPGA). By means of this circuitry, additional logic functionality may be provided which enables to operate based on the received control data. For example, the microphone adapter may comprise a memory which is configured to store the received control data from the mixing console. In such a scenario, the microphone adapter may enhance the logic functionality of the microphone by the additional features as mentioned above and yet to be explained. This enables to retrofit conventional analogue microphones with such additional features and functionality.

For example, the interface of the microphone adapter may be configured to send control data to the mixing console. For example, the microphone adapter may further comprise one or more user operation elements, such as, for example, one or more buttons, etc. By way of example, by pressing the button, control data may be sent to the mixing console. For example, the control data sent to the mixing console may enable a mute functionality and/or trigger a cough-function, i.e. trigger a temporary mute without interruption of a red light on-air indication. Also, a talk-back functionality may be implemented where a user of the microphone and a stage director and/or user of the mixing console can communicate. As can be seen from the above, the communication between the microphone adapter and the mixing console can be bi-directional and the operation of the microphone adapter can be inter-related with the operation of the mixing consoles.

It is possible that the control data indicates at least one audio processing property applied by the mixing console to the audio data. For example, the audio processing property may be selected from the group comprising: mute, on/off, gain level, echo, fade, talk-back, and/or cough key. It is, alternatively or additionally, also possible that the control data indicates at least one operation parameter of the mixing console, for example, lighting of an indication light. For example, if the visual indication corresponds to a red light which indicates that the audio data received from the microphone is processed by a corresponding audio processing channel of the mixing console, such that a considerable gain level is achieved. This may correspond to a red light indication which conventionally signals that a given microphone is "on air". By providing such red light indication functionality with the microphone adapter, it becomes possible to enhance the functionality of conventional analogue microphones. Such functionality as mentioned above may alternatively or additionally also be provided for control data sent from the microphone adapter to the mixing console.

The control data may include an indication of an audio source associated with the microphone. The visual indication may be multi-pixel display and may be configured to depict the label based on the indication of the audio source. Effects as previously mentioned above may be achieved.

The microphone adapter may further comprise a power unit configured to receive phantom power from the mixing console and a switch. The power unit may be configured to selectively forward the phantom power to the microphone in dependence of the setting of the switch. For example, the microphone adapter may receive the power from a phantom voltage "P48" provided from the mixing console. Depending on the position of the switch, the phantom power may be cleaned in the microphone adapter before being delivered to the microphone. If a dynamic microphone is attached to the microphone adapter, the switch may be put to an off position to ensure that no phantom power is delivered to the microphone. Thereby, damage to the dynamic microphone may be avoided.

It is to be understood that features mentioned above and features yet to be explained below can be used not only in the respective combinations indicated, but also in other combinations or in isolation, without departing from the scope of the present invention. The features of the above-mentioned aspects and embodiments may be combined with one another in other embodiments.

BRIEF DESCRIPTION OF THE DRAWINGS

FIG. 5 illustrates a routing table.

DETAILED DESCRIPTION

Figure 1:
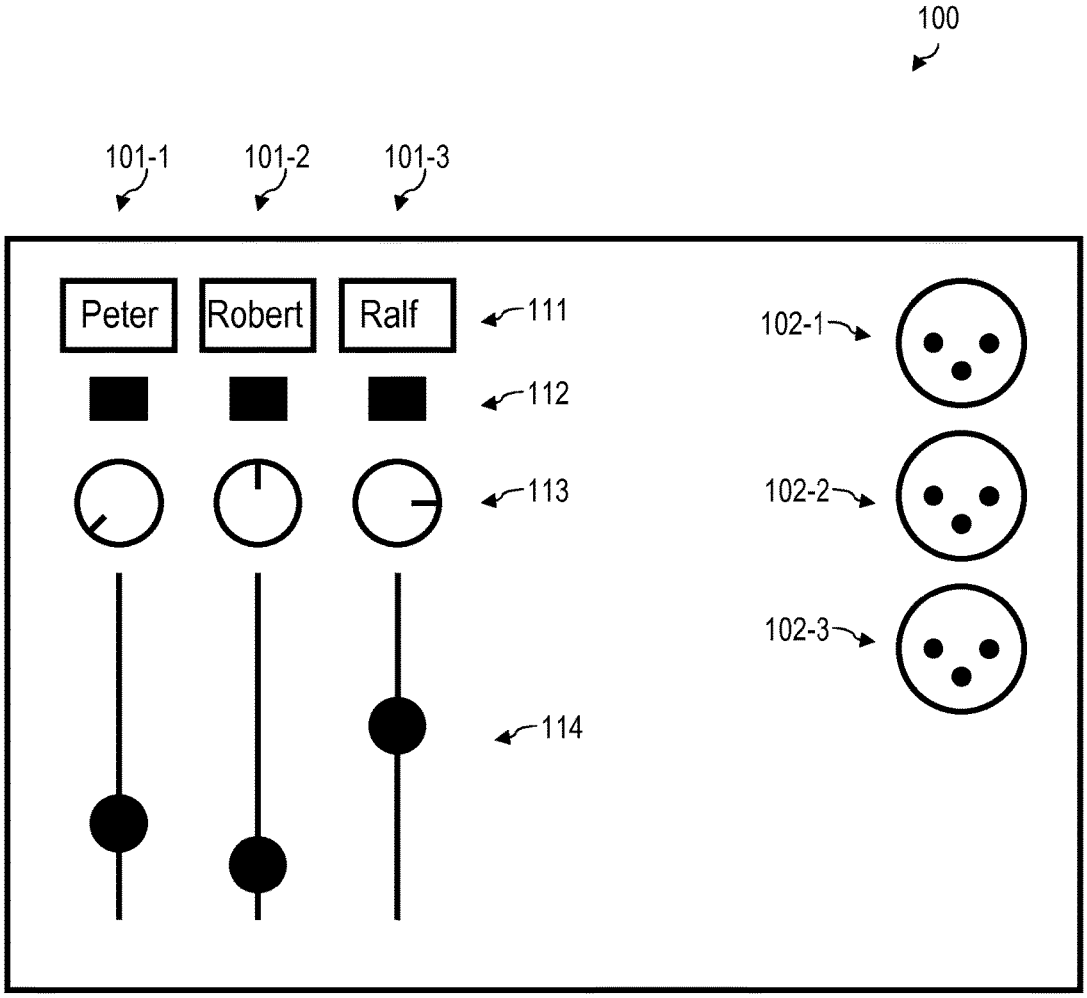
FIG. 1 is an illustration of a mixing console.

In the following, embodiments of the invention will be described in detail with reference to the accompanying drawings. It is to be understood that the following description of embodiments is not to be taken in a limiting sense. The scope of the invention is not intended to be limited by the embodiments described herein after or by the drawings, which are to be taken to be schematic and illustrative only.

The drawings are to be regarded as being schematic representations and elements illustrated in the drawings are not necessarily shown to scale. Rather, the various elements are represented such that their function and general purpose become apparent to the person skilled in the art. Any connection or coupling between functional blocks, devices, components, rather physical or functional units shown in the drawings or described herein may also be implemented by an indirect connection or coupling. A coupling between components may also be established over a wireless connection. Functional blocks may be implemented in hardware, firmware, software, or a combination thereof.

Hereinafter, techniques relating to the interaction of one or more microphones with a mixing console are discussed. In particular, control data comprising an indication of an audio source is signaled from the microphone to the mixing console and, based on the received indication of the audio signals, auto-routing is applied in the mixing console. Control data may also be signaled form the mixing console to the microphone. Further, a corresponding label may be depicted on a multi-pixel display of the mixing console and/or of the microphone. In this way, a user can see the label on the microphone and/or the mixing console and easily recognize corresponding user operation elements setting audio processing properties of the respective audio processing channel. Further, mix-up of various microphones between various speakers may be avoided. Further, a user may not be required to plug in a given microphone at one and the same audio input every time reconnection is intended.

FIG. 1 illustrates an mixing console 100. The mixing console 100 comprises three audio inputs 102-1, 102-2, 102-3. The audio inputs 102-1, 102-2, 102-3 are located remote form user operation elements 112, 113, 114 of three audio processing channels 101-1,101-2, 101-3. The user operation elements 112, 113, 114 are arranged in columns. Each column is associated with one of the audio processing channels 101-1, 101-2, 101-3. In FIG. 1, aspects relating to user interfacing like the user operation elements 112, 113, 114 with respect to audio processing executed by the audio processing channels 101-1, 101-2, 101-3 are illustrated. The user operation elements 112, 113, 114 are labeled by a corresponding label depicted on a multi-pixel display 111. Thereby, a user of the mixing console 100 can be aware which audio processing properties will be affected by actuation of a certain user operation element 112, 113, 114.

However, as can be seen from FIG. 1, due to the fact that the audio inputs 102-1, 102-2, 102-3 are located remote from the user operation elements 112, 113, 114, the user needs to be aware of the routing between audio data received at the various audio inputs 102-1, 102-2, 102-3 and the various audio processing channels 101-1, 101-2, 101-3. This routing may be flexibly set. Hereinafter, techniques will be described, which facilitate this routing, i.e., where so-called auto-routing may be applied. Auto-routing may refer to a scenario where a microphone (not shown in FIG. 1) which had been previously connected to the mixing console 100 is recognized and the routing is setup such that the audio data received from the microphone is forwarded to the previous audio processing channel 101-1, 101-2, 101-3.

Figure 2:
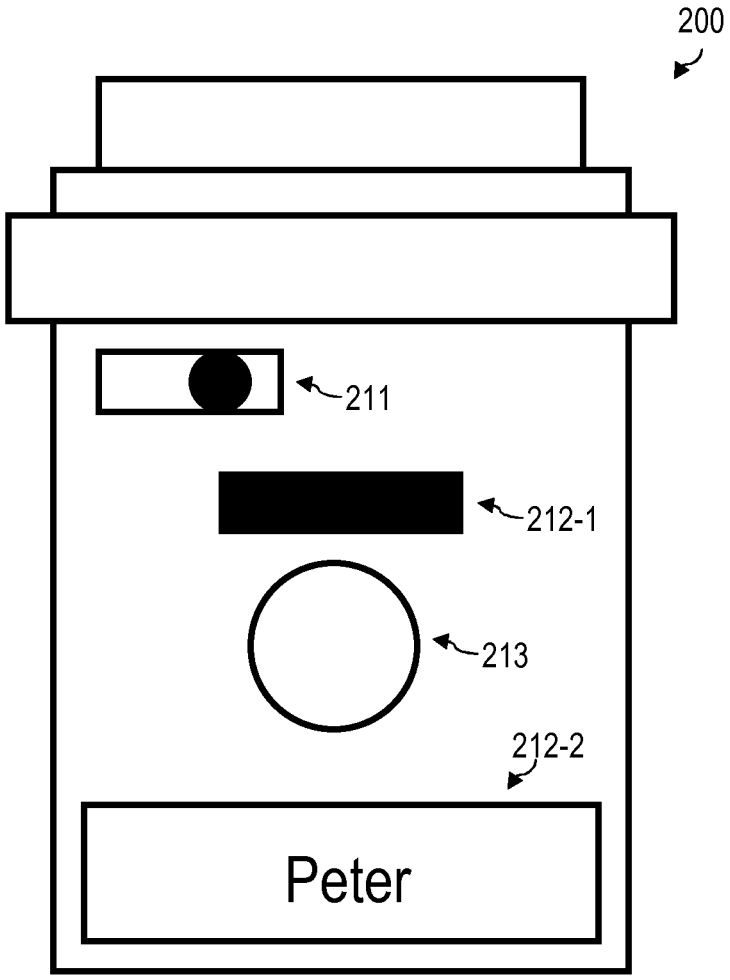
FIG. 2 is an illustration of a microphone adapter.

For this, inter alia, a microphone adapter 200 is proposed (see FIG. 2) which interacts with the mixing console 100. The microphone adapter 200 comprises two visual indications 212-1, 212-2. A larger number of visual indications may be provided. One of the visual indications 212-1, 212-2 corresponds to a red light indication. The red light indication 212-1 will light up if the analogue microphone connected to the microphone adapter 200 is on air, i.e. if the corresponding user operation element 112, 113, 114 of the respective audio processing channels 101-1, 101-2, 101-3 of the mixing console 100 (see FIG. 1) and/or an output path configuration is properly set. The red light indication 212-1 may be in the form of a ring enclosing the microphone adapter 200. It is also possible to assign a state indication, e.g., mute on/off to the visual indication 212-1 or a separate, dedicated visual indication (not shown).

A multi-pixel display 212-2 displays the label "Peter". In other words, the audio source associated with the microphone adapter 200, respectively the microphone attached to the microphone adapter 200, is the speaker "Peter". Certain specific audio processing properties may be associated with this speaker "Peter". As can be seen from a comparison of the FIGS. 1 and 2, the corresponding label information is also depicted on the multi-pixel display 111 of the audio processing channel 101-1 of the mixing console 100. Therefore, once connection with the microphone adapter 200 of FIG. 2 and the mixing console 100 of FIG. 1 is established, independent of the particular audio input 102-1, 102-2, 102-3 to which the microphone adapter 200 is plugged in, audio data received from the microphone adapter 200 will be routed to the audio processing channel 101-1 where the specific audio processing properties are provisioned. In general, the control data includes an indication of the audio source associated with the microphone and a router of the mixing console 100 is configured to route the audio data from a particular audio input 102-1, 102-2, 102-3 to a given audio processing channel 101-1, 101-2, 101-3 based on the received indication of the audio source.

Further, the microphone adapter 200 comprises a power unit (not shown in FIG. 2), which is configure to receive phantom power from the mixing console 100. The various functionalities of the microphone adapter 200 can be powered by the phantom power received via the power unit. The microphone adapter 200 further comprises a switch 211, which can be set to two positions. The power unit of the microphone adapter 200 is configured to selectively forward the phantom power to the microphone in dependence of the setting of the switch. For example, if a dynamic microphone is attached to the microphone adapter 200, the switch 211 should be set accordingly, such that the phantom power is not forwarded and damage to the dynamic microphone is avoided.

The microphone adapter 200 further comprises a button 230. Various functionalities can be implemented by means of the button 230, e.g., mute function, cough function, talk back function, or in general any general purpose interface (GPI) supported function. Of course, the microphone adapter 200 may comprise a larger number and/or different types of user operation elements. To support this function, the microphone adapter 200 is configured to signal respective control data to the mixing console 100.

Figure 3:
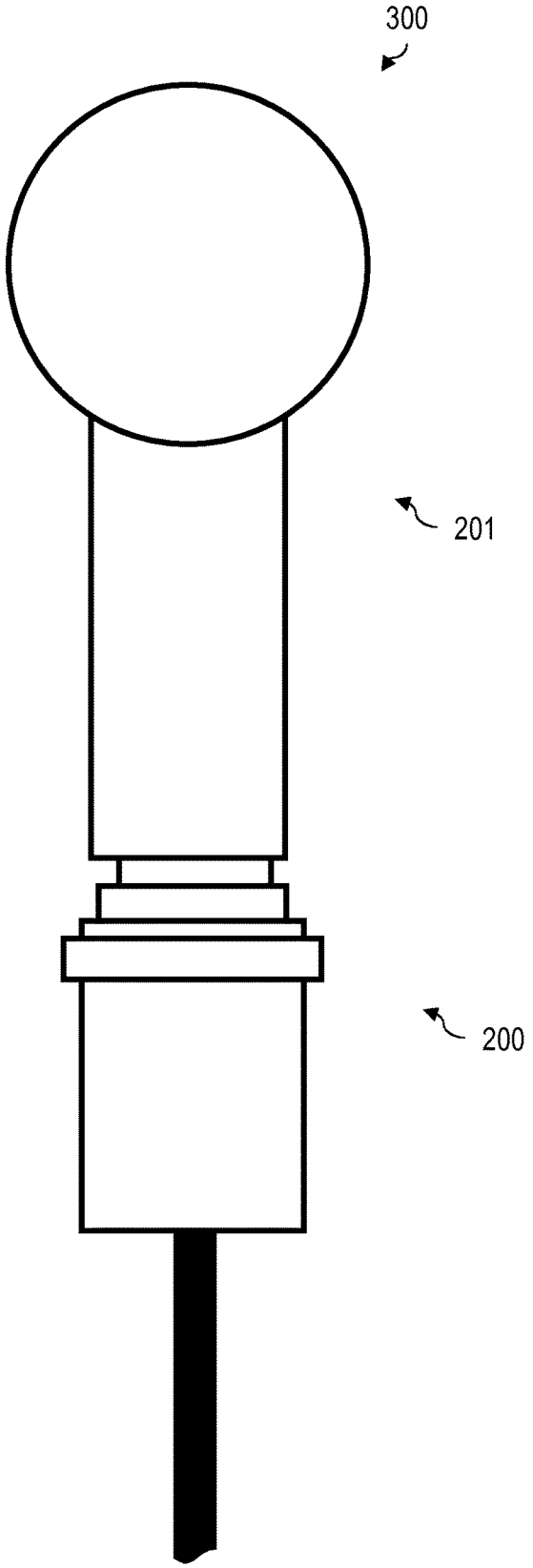
FIG. 3 is an illustration of a microphone comprising an analogue microphone and a microphone adapter.

In FIG. 3, a microphone 300 is shown. The microphone 300 comprises the microphone adapter 200 and an analogue microphone 201. For example, it would also be possible to attach an analogue microphone 201 which comprises active elements to a microphone adapter 200. Then, depending on the setting of the switch 211 (see FIG. 2), the microphone adapter 200 can drive the active functionality of the active microphone 201. In general, the microphone 300 can be a single entity and does not need to comprise the separate adapter 200; in other words, the functionality of the microphone adapter 200 may be built into a one-piece microphone 300.

Figure 4:
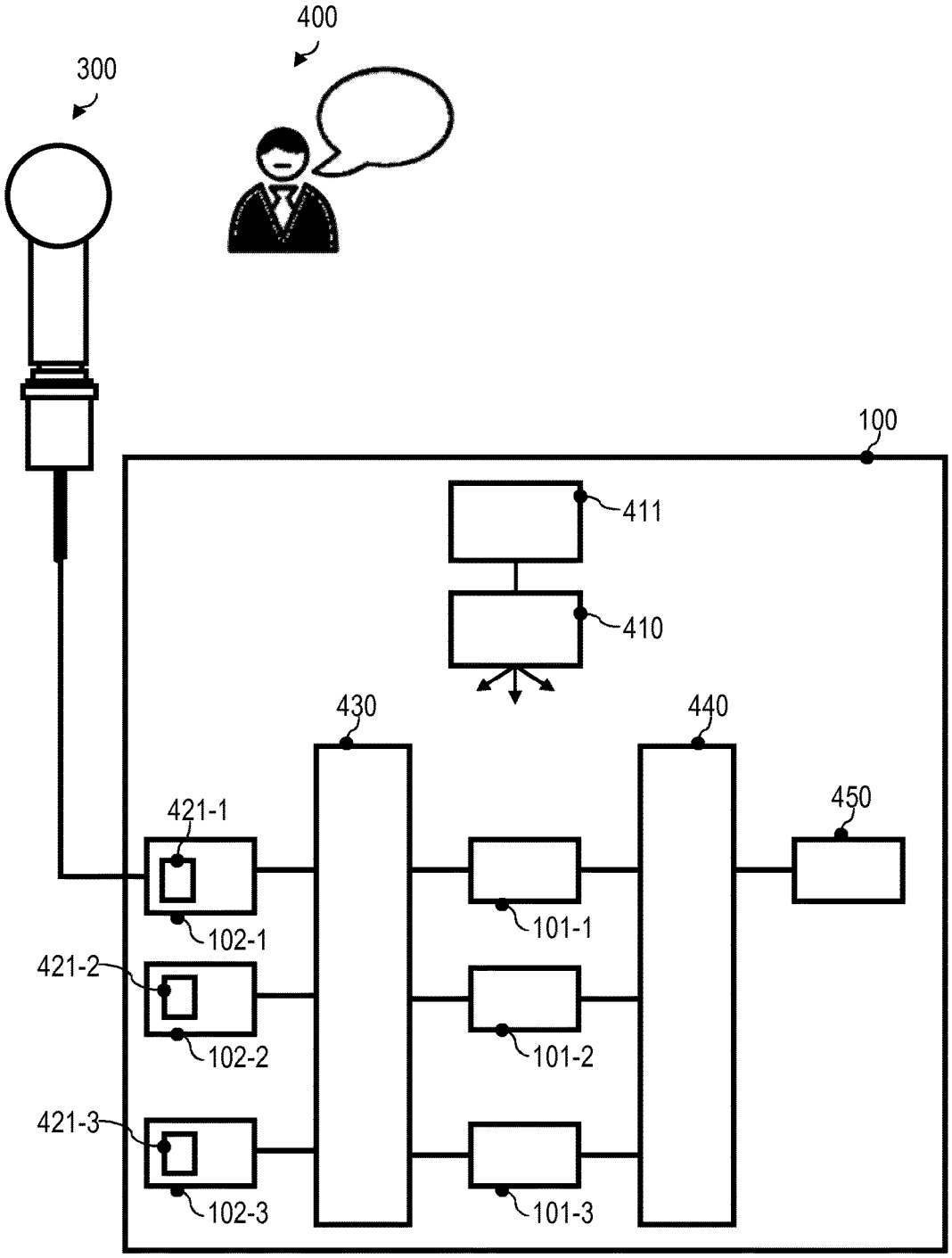
FIG. 4 is a schematic illustration illustrating the microphone in communication with the mixing console.

In FIG. 4, a setup of the microphone 300 being connected to the mixing console 100 is schematically shown. FIG. 4 is an audio block diagram. In FIG. 4, the connection between the microphone 300 and the mixing console 100 is a fixed-line connection; however, it should be understood that the connection used for the audio data and/or the control data could also be implemented as a wireless connection, for example, according to the WLAN standard and/or any proprietary standard.

Furthermore shown in FIG. 4 is an audio source, or speaker 400, associated with the microphone 300. The control data sent from the microphone 300 to the mixing console 100 includes an indication of the speaker 400. The control data of the microphone 300 is received by the interface 421-1, which in the scenario of FIG. 4 is integrated with the audio input 102-1. However, in general the interfaces 421-1, 421-2, 421-3 can be located remote from the audio inputs 102-1, 102-2, 102-3.

The microphone 300 generates an analogue or digital signal, i.e., the audio data. The audio data is fed through the cable to the audio input 102-1, which can comprise a microphone preamplifier. Here, the audio data is amplified (amplifiers not shown in FIG. 4) and, if necessary, converted to digital format. The router 430 distributes the audio data to the desired audio processing channel, for example, to the audio processing channel 101-1. Different than in FIG. 1, in FIG. 4 aspects of the audio processing channels 101-1, 101-2, 101-3 relating to the processing of the audio data are illustrated. In the audio processing channel 101-1, the audio data can be processed based on audio processing properties which can be set, for example, by the user operation elements 112, 113, 114 (cf. FIG. 1). A summing matrix 440 sums the processed audio data that must be mixed to the same output 450.

A control entity 410 which can access a memory 411 is provided. For example, the control entity 410 can control the various functionalities of the mixing console 100. For this purpose, the control entity 410 can be in communication with each one of the above-mentioned entities. (as indicated by the arrows in FIG. 4).

Below, the auto-routing functionality mentioned above is described. The router 430 is configured to route the audio data from the audio input 102-1 to one or more of the audio processing channels 101-1, 101-2, 101-3, based on the indication of the audio source 400 received as part of the control data obtained via the interface 421-1. In particular, the router 430 is configured to route the audio data to one of the audio processing channels 101-1, 101-2, 101-3 in dependence of a corresponding entry 500-1*a*, 500-1*b*, 500-1*c*, 500-1*d*, 500-1*e* of a predefined routing table 500, see FIG. 5. For example, in the scenario of FIG. 4, the indication of the audio source 400 corresponds to the label "Peter" (see FIG. 2). This corresponds to the first entry 500-1*a* of the routing table 500. Then the router 430 will route the audio data to the audio processing channel 101-1, 101-2, 101-3 identified by the number 3. Further, a corresponding snapshot, for example, one or more audio mixing parameters such as volume, equalizing frequency, etc. may be set for the processing of the audio data by the control entity 410. A snapshot may be stored or recalled by the user by pressing a button; it may be triggered by an event, e.g., time code, external automation, etc.

For example, if a further microphone 300 is connected to the audio input 102-2 and control data is received from the further microphone 300 which includes an indication of an audio source not yet listed in the routing table 500, a new entry 500-1*a*-500-1*e*, can be created. This may occur based on a user input and/or a predefined link between the particular audio input 102-2 and one of the audio processing channels 101-1, 101-2, 101-3. The creating of the new label can correspond to a setup mode.

It is also possible, in the setup mode, to assign a certain audio source 400 to the microphone 300. The setup mode may be triggered in various ways, for example, by pushing the button 230 of the microphone adapter 200 which triggers respective control data which includes a request for an indication of the audio source 400. It is also possible that the user of the mixing console 100 actuates a respective user operation element 112, 113 114 of the mixing console 100. For example, the indication of the audio source 400 may be a user-defined label. The user-defined label may include at least one alphanumeric character. It may be set by an appropriate human-machine interface (HMI) of the mixing console 100.

Figure 6:
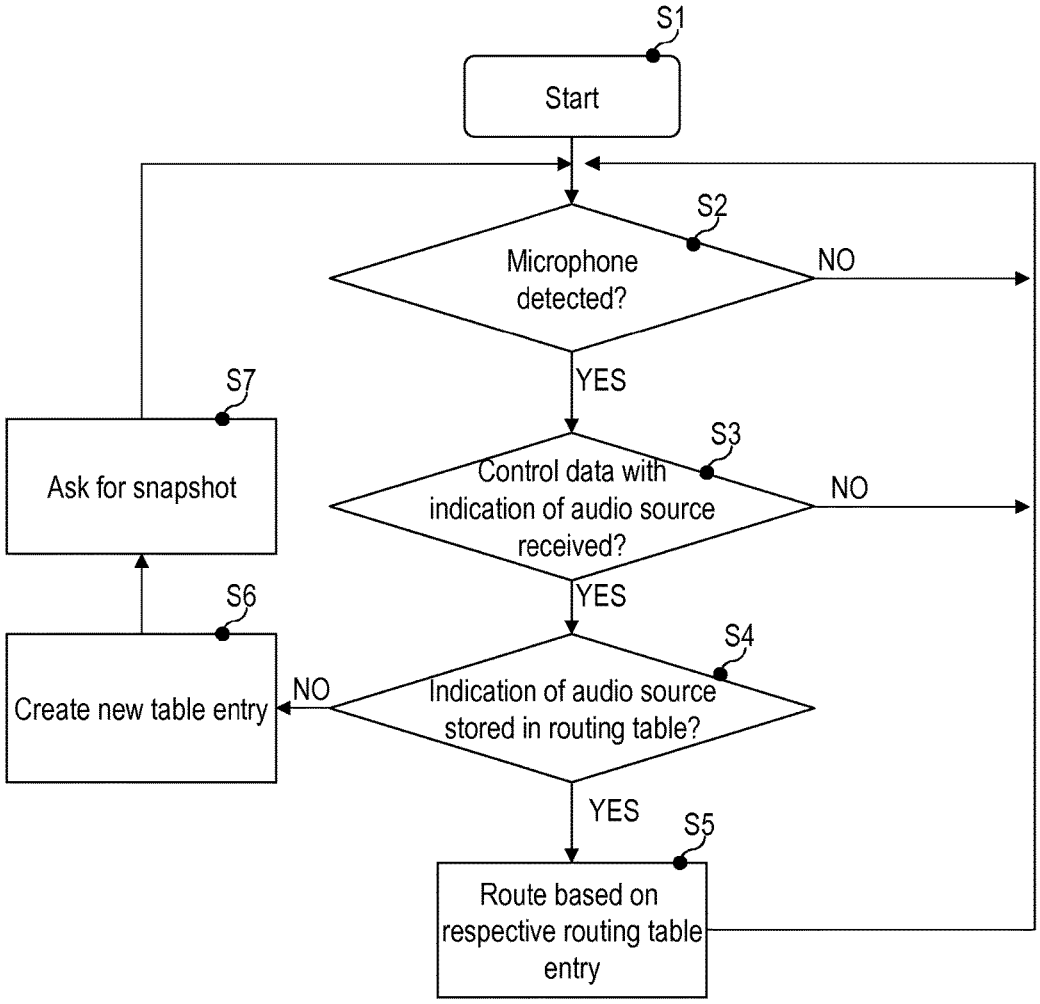
FIG. 6 is a flow chart of a method according to various aspects of the present invention.

FIG. 6 is a flowchart of a method of controlling operation of the mixing console 100 according to various embodiments. For example, the various steps as illustrated in FIG. 6 can be executed by a processor of the control entity 410 of the mixing console 100. The method starts with step S1. Upon power up, the routing table 500 will be loaded into the memory 411. It is then accessible to the control entity 410.

In step S2, the control entity 410 continuously and iteratively scans the various audio inputs 102-1, 102-2, 102-3. Once a microphone 300 is plugged into one of the audio inputs 102-1, 102-2, 102-3, the method commences with step S3. Here it is checked whether control data including the indication of the audio source 400 is received from the microphone 300 detected in step S2. The control data is received by the corresponding interface 421-1, 421-2, 421-3. For example, the control data can be received via modulation of the phantom power driven by the mixing console 100 to power the microphone 300, or the microphone adapter 200. It could also be received via a WLAN connection. The respective indication of the audio source 400 can be provisioned in an internal memory of the microphone 300. It can be signaled by the microphone adapter 200 to the mixing console 100 if it is detected that the microphone adapter 200 is connected to the mixing console 100, or for example, if the button 230 is being pressed by a user.

If, in step S3, control data with the indication of the audio source 400 is received, the method commences in step S4. Here, it is checked whether the corresponding indication of the audio source 400 is already stored in a routing table 500. If this is the case, the router 430 is accordingly configured, i.e. to forward the audio data received from the microphone 300 from the respective audio input 102-1, 102-2, 102-3 to the audio processing channel 101-1, 101-2, 101-3 as indicated by the corresponding entry 500-1*a*-500-1*e* of the routing table 500.

If the routing table 500 also includes an indication of the input port (see FIG. 5), it can be checked whether the current input port 102-1, 102-2, 102-3 matches the input port as indicated by the respective entry 500-1*a*-500-1*e* of the routing table 500. If these numbers do not match, the routing table 500 can be updated and/or a respective message can be issued to the user. Further, once the router 430 has been correspondingly configured (step S5), the multi-pixel display 111 of the respective audio processing channel 101-1, 101-2, 101-3 of the mixing console 100 can be configured to display a label associated with the indication of the audio source 400.

If, in step S4, it is determined that no corresponding indication of the audio source 400 is stored in the routing table 500, the method commences with step S6. In step S6, a new table entry 500-1*a*-500-1*e* is created in the routing table 500. In step S7, the user is asked for a snapshot, i.e. predefined audio processing properties which should be applied to the audio data received from the microphone 300.

Although the invention has been shown and described with respect to certain preferred embodiments, equivalents and modifications may occur to others skilled in the art upon the reading and understanding of the specification. The present invention includes all such equivalents and modifications and is limited only by the scope of the appended claims.

What is claimed is:

1. A mixing console having a plurality of audio inputs and a plurality of audio processing channels, the mixing console comprising:

an interface configured to receive control data from a microphone, the microphone being connected to a first audio input to provide audio data, wherein the control data includes an indication of an audio source associated with the microphone;

a router configured to route the audio data from the first audio input to a first audio processing channel based on the received indication of the audio source, where in the first audio processing channel, the audio data from the microphone is processed based on first audio processing properties; and a second audio input being connected to the microphone after the microphone is disconnected from the first audio input, wherein the router is further configured to route the audio data from the microphone to the first audio processing channel while the microphone is connected to the second audio input without user intervention to enable the audio data from the microphone to be processed based on the first audio processing properties in the first audio processing channel.

2. The mixing console of claim 1, further comprising:

a memory configured to store a predefined routing table which links the indication of the audio source with the first audio processing channel, wherein the router is configured to route the audio data to the first audio processing channel in dependence of a corresponding entry of the predefined routing table.

3. The mixing console of claim 2, wherein the predefined routing table further links the indication of the audio source with at least one of the first audio input and at least one audio processing parameter.

4. The mixing console of claim 2, further comprising:

a control entity configured to detect a connection setup of a further microphone at one of the plurality of audio inputs, wherein the control entity is further configured to, in response to the detecting of a connection setup of the further microphone, create a new entry of the predefined routing table in dependence of a user input and/or a predefined link between the respective audio input and one of the plurality of audio processing channels.

5. The mixing console of claim 2, wherein the predefined routing table includes a plurality of entries; and wherein the interface is further configured to, in response to a request received from the microphone, signal to the microphone the control data which includes the indication of the audio source of one of the plurality of entries of the predefined routing table.

6. The mixing console of claim 2, wherein the interface is further configured to, in a setup mode which assigns the audio source to the microphone, signal to the microphone further control data which includes the indication of the audio source.

7. The mixing console of claim 1, wherein a setup mode which assigns the audio source to the microphone is triggered by one or more events selected from the group comprising:

receiving of control data from the microphone which includes a request for an indication of an audio source;

actuating of a user operation element of the mixing console associated with one of the plurality of audio processing channels; and receiving control data from the microphone which indicates actuation of a user operation element of the microphone.

8. The mixing console of claim 1, further comprising:

for each one of the plurality of audio processing channels; a multi-pixel display which is configured to depict a label associated with the respective audio processing channel; and a control entity which is configured to set the label associated with the first audio processing channel based on a received indication of the audio source.

9. The mixing console of claim 1, wherein the interface is in connection with the first audio input and is configured to apply a phantom power to a wired audio connection for signaling of the audio data between the first audio input and the microphone; and wherein the interface is configured to establish a data connection for signaling of further control data to the microphone via modulation of the phantom power.

10. The mixing console of claim 1, wherein the indication of the audio source is a user-defined label which includes at least one alphanumeric character.

11. A microphone which is in communication with the mixing console of claim 1, comprising:

a multi-pixel display configured to depict a label based on the indication of the audio source associated with the microphone.

12. A mixing console comprising:

an interface configured to receive control data from a microphone, the microphone being connected to a first audio input of a plurality of audio inputs to provide audio data, the control data providing an indication of an audio source associated with the microphone; and a router configured to route the audio data from a first audio input to a first audio processing channel of a plurality of audio processing channels based on the indication of the audio source, where in the first audio processing channel, the audio data from the microphone is processed based on first audio processing properties; and a second audio input being connected to the microphone after the microphone is disconnected from the first audio input, wherein the router is further configured to route the audio data from the microphone to the first audio processing channel while the microphone is connected to the second audio input without user intervention to enable the audio data from the microphone to be processed based on the first audio processing properties in the first audio processing channel.

13. The mixing console of claim 12, further comprising:

a memory configured to store a predefined routing table which links the indication of the audio source with the first audio processing channel, wherein the router is configured to route the audio data to the first audio processing channel in dependence of a corresponding entry of the predefined routing table.

14. The mixing console of claim 13, wherein the predefined routing table further links the indication of the audio source with at least one of the first audio input and at least one audio processing parameter.

15. The mixing console of claim 13, further comprising:

a control entity configured to detect a connection setup of a further microphone at any one of the plurality of audio inputs, wherein the control entity is further configured to, in response to detecting the connection setup of the further microphone, create a new entry of the predefined routing table in dependence of at least one of a user input and a predefined link between the respective audio input and one of the plurality of audio processing channels.

16. The mixing console of claim 13, wherein the predefined routing table includes a plurality of entries; and wherein the interface is further configured to, in response to a request received from the microphone, signal to the microphone the control data which includes the indication of the audio source of one of the plurality of entries of the predefined routing table.

* * * * *